US005658099A

United States Patent [19]

Pienaar et al.

[11] Patent Number: 5,658,099

[45] Date of Patent: Aug. 19, 1997

[54] PROP HEADBOARD

[75] Inventors: Frans Roelof Petrus Pienaar, Krugersdorp; Brian Peter Lewis, Meredale; Peter John Cook, Kibler Park, all of South Africa

[73] Assignee: HL & H Timber Products (Propreitary) Limited, Parktown, South Africa

[21] Appl. No.: 310,682

[22] Filed: Sep. 22, 1994

[30] Foreign Application Priority Data

Sep. 24, 1993 [ZA] South Africa ..... 93/7093

[51] Int. Cl.[6] ..... E02D 3/02; E02D 5/00; E02D 17/00; E02D 29/00

[52] U.S. Cl. ..... 405/288; 248/357

[58] Field of Search ..... 405/288, 289, 405/290, 302.1; 248/357, 354, 354.1, 354.6

[56] References Cited

U.S. PATENT DOCUMENTS

| | | | |
|---|---|---|---|
| 931,466 | 8/1909 | Nellen | 405/288 X |
| 1,528,034 | 3/1925 | Thielmann . | |
| 1,946,720 | 2/1934 | Stearns . | |
| 2,190,556 | 2/1940 | Wiebecke et al. | 405/288 |
| 3,703,269 | 11/1972 | Meriz | 248/354 L |
| 4,004,771 | 1/1977 | Plevak et al. | 248/357 |
| 4,120,164 | 10/1978 | Tomlin | 405/288 X |
| 4,465,405 | 8/1984 | Dürrfeld | 405/289 |
| 4,773,792 | 9/1988 | Landers | 405/230 |
| 5,149,228 | 9/1992 | Pienaar et al. | 405/289 |
| 5,186,430 | 2/1993 | Ellithrope | 248/354.3 |
| 5,288,178 | 2/1994 | Pienaar | 405/288 |

FOREIGN PATENT DOCUMENTS

| | | | |
|---|---|---|---|
| 1027158 | 4/1958 | Germany . | |
| 1-027157 | 4/1958 | Germany . | |
| 1177588 | 9/1964 | Germany . | |
| 827733 | 10/1982 | South Africa | 405/288 |
| 912947 | 3/1982 | U.S.S.R. . | |
| 396454 | 10/1932 | United Kingdom . | |

OTHER PUBLICATIONS

HL&H Mining Timber 1992; *Propsetter™ Assembly Procedure;* (1992) (2 p.).

*Primary Examiner*—Dennis L. Taylor
*Attorney, Agent, or Firm*—Conley, Rose & Tayon, P.C.

[57] ABSTRACT

The prop headboard is used to support an inflatable grout bag on the head of an elongate prop. The headboard has a timber frame which presents a planar support surface suitable for supporting the inflatable grout bag. Bag-retaining flaps made of flexible fabric material extend from opposite edges of the headboard. These flaps are folded over the grout bag and serve to centralise it on the headboard and to restrain it from rolling out sideways during inflation and thereafter. The invention also concerns a prop system in which the headboard is used, and a method of supporting a hanging wall in a mine working.

13 Claims, 2 Drawing Sheets

FIG.3
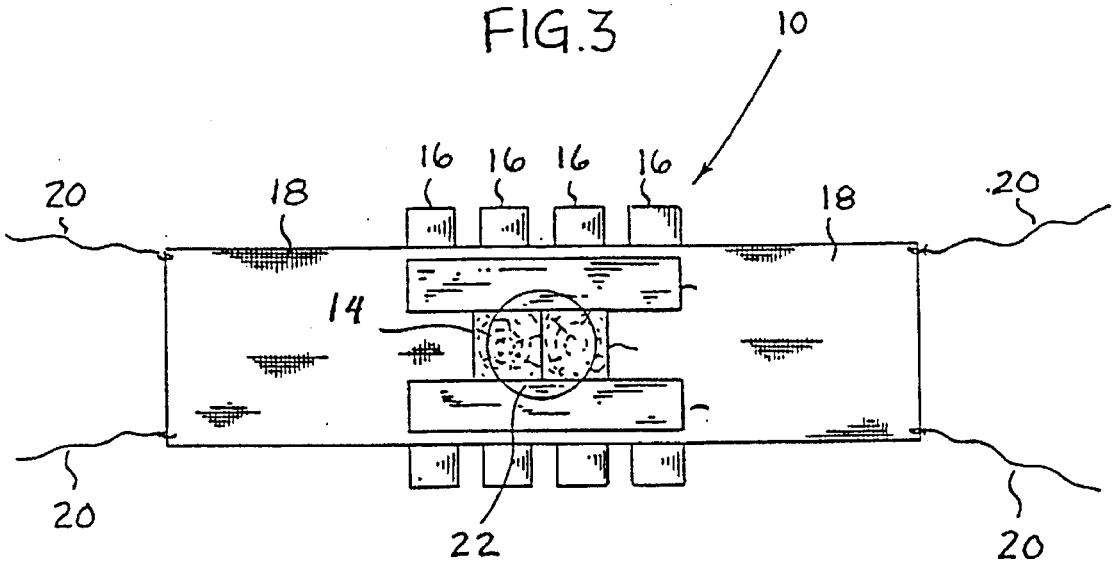
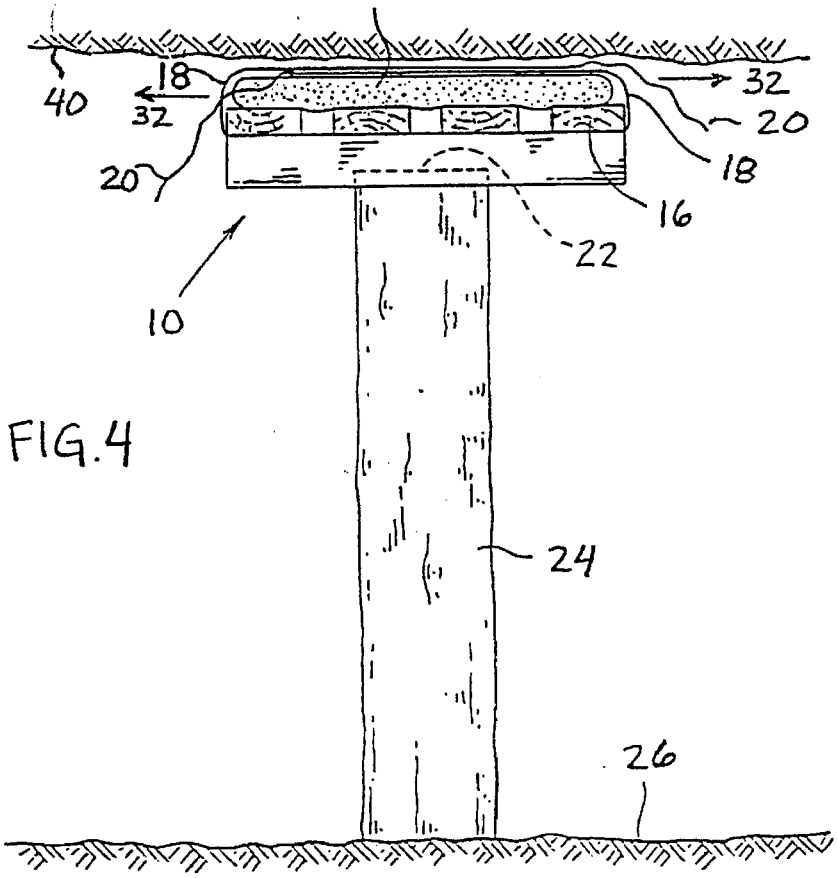
FIG.4

PROP HEADBOARD

BACKGROUND TO THE INVENTION

THIS invention relates to a prop headboard.

It has already been proposed to preload a mine support prop by providing it with a transversely extending headboard which supports an inflatable grout bag. In practice, the prop is erected upright on the footwall of a mine working, with the headboard spanning transversely across the head of the prop. The grout bag is placed on top of the headboard and is inflated with a suitable grout under pressure. The inflation of the bag with grout, which is normally of a rapid setting type, causes the bag to expand forcibly against the handing wall and to apply an axial preload force to the prop. The axial preloading of the prop enables it immediately to take the loading applied by the handing wall.

A number of different headboard arrangements have already been proposed but are, generally speaking, rather expensive to manufacture. It is an objective of the present invention to provide a headboard which can be constructed at modest cost.

SUMMARY OF THE INVENTION

According to the invention there is provided a prop headboard which comprises a plurality of elongate timber members connected to one another to form a frame which presents an operatively upper, generally planar support surface dimensioned to support an inflatable grout bag, and a pair of bag-retaining flaps extending from opposite edges of the headboard, the flaps being made of a flexible fabric material and being foldable in opposite directions over the grout bag in use.

Conveniently the flaps are provided by a single length of the fabric material, typically a woven polypropylene, fastened to the timber frame. Cords, strings or straps are attached to and extend from the flaps to facilitate positioning of the flaps over the grout bag in use.

In a preferred embodiment, the frame comprises spaced apart, parallel, elongate, cross-grain timber members, endgrain timber blocks located between and connected to the timber members, and cross-grain timber deck members defining the planar support surface. A recess can be formed in the underside of the frame to receive the end of an elongate prop.

The planar support surface is preferably square in shape, with dimensions of approximately 55 cm×55 cm, so that it is suitable to support a standard 55 cm×55 cm PROPSETTER (trade mark) inflatable grout bag.

According to another aspect of the invention there is provided a prop system which comprises an elongate prop extending upright from the footwall towards the hanging wall in a mine working, a prop headboard as summarised above, the prop headboard spanning across the upper end of the prop, and an inflatable grout bag located on the planar support surface of the headboard, the bag-retaining flaps of the headboard being folded in opposite directions over the grout bag to centralise the bag on the support surface and to restrain lateral movement of the bag when it is inflated with settable grout that expands the bag against the handing wall.

According to a further aspect of the invention there is provided a method of supporting the handing wall above the footwall in a mine working, the method comprising the steps of erecting an elongate prop at an upright attitude on the footwall of the mine working, locating a prop headboard, summarised above, on the upper end of the elongate prop, locating an inflatable group bag on the planar support surface of the prop headboard, folding the flaps of the prop headboard in opposite directions over the grout bag, inflating the group bag with a settable grout so as to expand the group bag against the handing wall and place the elongate prop under axial compression, and allowing the grout to set in the grout bag.

In the prop system and method the upper end of the elongate prop may located in a recess formed in the underside of the headboard frame. Preferably, the arrangement is such the endgrain timber blocks of the headboard frame bear upon the upper end of the elongate prop.

BRIEF DESCRIPTION OF THE DRAWINGS

The invention will now be described in more detail, by way of example only, with reference to the accompanying drawings in which:

FIG. 3 shows an underplan view of the headboard to the preceding FIGS.; and

FIG. 4 shows a side view of a headboard system according to the invention installed in a mine stope.

DESCRIPTION OF AN EMBODIMENT

The prop headboard 10 seen in the Figures is constructed primarily from timber members connected to one another to form a timber frame. These timber members include a pair of spaced apart, parallel members 12, a pair of timber blocks 14 located between the members 12, and four timber deck members 16 spanning transversely across the members 12. All of these timber members are preferably of Saligna.

In this embodiment, the timber members 12 are so-called "trimslabs", i.e. lengths of timber which have been trimmed to an approximately rectangular, in this case square, shape. They are arranged in a crossgrain configuration, i.e. the direction of load application in use is transverse to the grain direction.

The blocks 14 are trimmed to generally a cube-shape and are arranged side by side, between the members 12, in an endgrain configuration, i.e. the direction of load application in use is parallel to the grain direction which, as will be appreciated from the Figures, is substantially vertical. The timber members 12 and blocks 14 are connected together by the known spindrilling technique. In this technique, wires with sharp tips are drilled right through the members 12 and blocks 14 and the ends of the wires are then bent over to secure them in place.

The deck members 16 also have rectangular cross-sections. In this embodiment, pairs of deck members 16 are made by cutting timber members, such as the members 12, in a lengthwise direction. The deck members 16 are nailed to the members 12 and present a generally planar upper support surface.

Figure 2:
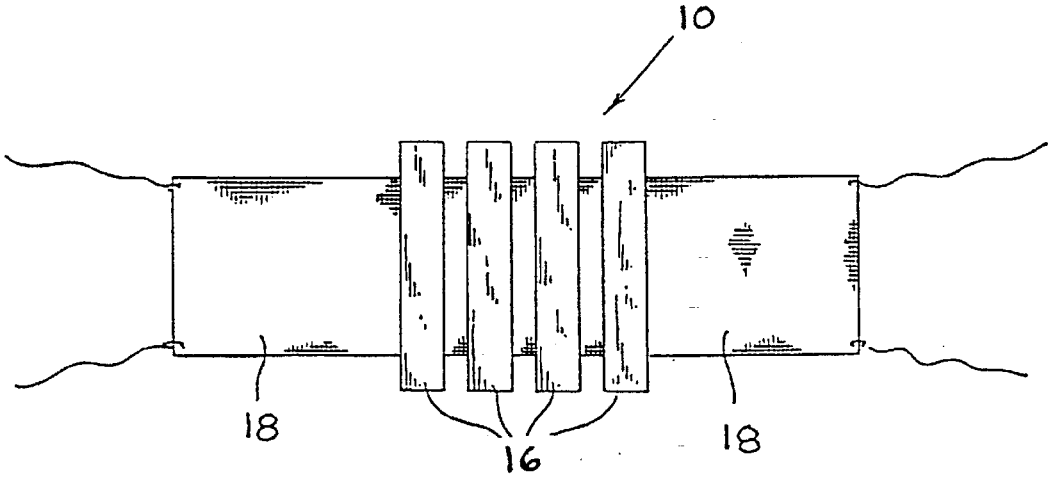
FIG. 2 shows a plan view of the headboard seen in FIG. 1.

The members 12 and 16 all have the same length so that the resulting timber frame is square in plan, as will be apparent from FIGS. 2 and 3. In this case, the timber frame has dimensions of 55 cm×55 cm. The members 12 are typically 55 cm×10 cm×10 cm trimslabs and the blocks 14 are typically 13 cm×13 cm×10 cm blocks. Lengthwise sawing of members such as the members 12 to form the deck members 16 results in deck members with typical dimension of 55 cm×10 cm×4.5 cm.

Although mention has been made of specific cross-sectional shapes and dimensions of the timber components, it should be noted that many other shapes and dimensions are also possible. For instance, it is within the scope of the invention for the members 12 and blocks 14 to consist of untrimmed, round section timber lengths, and for the deck members 16 to consist merely of longitudinally split members such as the members 12.

Figure 1:
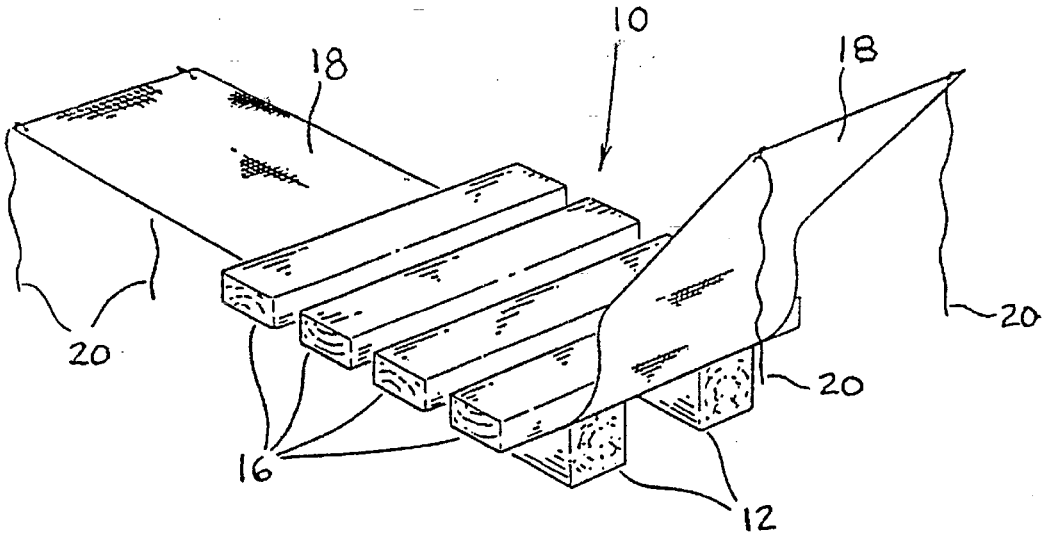
FIG. 1 shows a perspective view of a prop headboard according to the invention.

The headboard 10 includes a pair of flaps 18 which extend beyond opposite sides of the timber frame as illustrated in FIGS. 1 to 3. In this embodiment, the flaps are provided by a single rectangular length of woven polypropylene which is located between the timber members 12 and the deck slabs 16. The nails which are used to secure the deck slabs 16 to the members 12 pass through the polypropylene material and anchor it in position.

In the illustrated embodiment, the polypropylene has an overall length of 1500 cm, a width of 400 mm and a thickness of 0,6 mm. Attached to the free ends of the flaps 18, on opposite sides of the timber frame, are flexible cords 20. During transportation of the headboard, the flaps 18 can be folded about the underside of the timber frame and the cords tied to one another to hold the flaps neatly and compactly against the frame.

Referring to FIGS. 3 and 4, it will be noted that a shallow, round recess 22 is formed in the underside of the timber frame, partially in the members 12 and partially in the blocks 14. In this case, the recess has a diameter of 200 mm and a depth of 15 mm.

FIG. 4 illustrated the operation of the headboard described above. The headboard is placed on the upper end of a 200 mm diameter timber prop 24, with the upper end of the prop locating in the recess 22. As illustrated, the prop stands upright of the footwall 26 of a mine working. A 55 cm×55 cm inflatable grout bag 30, typically of the known king marketed by the assignee of the present invention under the trade mark PROPSETTER is located on the support surface provided by the deck members 16. The flaps 18 are then folded in opposite directions over the bag with one flap overlapping the other. The cords 20 are pulled in opposite directions to ensure that the flaps 18 lie tantly over the bag 30.

The bag 30 is then inflated by pumping a settable cementitious grout into it through the conventional filter nozzle (not illustrated). As the bag inflates with grout and expands in the vertical direction the flaps 18 are free to slip over one another, to accommodate the expansion of the bag, until such time as they are pressed against the handing wall 40 of the mine working by the bag. Pumping of grout into the bag continues until a predetermined pressure is achieved in the bag, corresponding to a desired axial preload force on the prop 24.

The grout is then permitted to set, with the preload force that the prop is subjected to rendering it immediately suitable to take the axial loading imposed by the handing wall as the handing wall closes towards the footwall.

The flaps 18 are an important feature of the headboard. Their initial function when pulled taut over the bag 30 prior to bag inflation is to centralise the bag on the upper support surface of the headboard.

Thereafter, during inflation and when in contact with the handing wall, the flaps prevent the bag from "rolling out" sideways, i.e. moving in the directions indicated by the arrows 32 off the support surface, even if the prop should be installed initially at a non-vertical inclination or skew away from the vertical under the applied loading. Thus the bag is maintained in position on the headboard to transfer vertical load to the prop 24.

It is believed that the headboard described above can be manufactured at modest cost. One important factor which reduces the cost when compared to known headboards is the use of fabric flaps 18 as opposed to sheet steel flaps as used previously. Another cost-reducing factor in some embodiments is the ability to use timber components which are largely unmachined.

The use of engrain timber blocks 14 at the point of load transfer to the upper end of the prop is also considered advantageous. Because of their endgrain orientation, the blocks are able to take considerably more compressive load without failing than would be the case with cross-grain blocks of corresponding dimensions. By using endgrain blocks at the zone of greatest stress, the load bearing capacity of the headboard can increased without the necessity for additional reinforcement.

We claim:

1. A prop headboard for supporting an inflatable grout bag, comprising:

a plurality of timber members connected to one another to form a frame which is mountable on an elongate prop, said frame including a first series of substantially parallel, elongate timber frame members and a second series of substantially parallel, elongate timber deck members, said deck members being connected to and extending transversely over said timber frame members, said deck members defining a generally planar support surface dimensioned to support the inflatable grout bag, and a length of flexible fabric material, said fabric material extending between said timber frame members and said timber deck members and further extending beyond said deck members so as to define a pair of opposed flexible bag-retaining flaps, said flaps being foldable in opposite directions over the grout bag when it is positioned on said planar surface, whereby said flaps serve to centralize the grout bag on said planar surface and restrain it against lateral movement relative to said frame.

2. The prop headboard according to claim 1 wherein said fabric material comprises woven polypropylene.

3. The prop headboard according to claim 2, further including at least one cord attached to and extending from each of said bag-retaining flaps.

4. A prop system according to claim 1, further including endgrain timber blocks which are located between the timber frame members and which space said timber fame members apart from one another, and further including wires which extend through said timber frame members and said endgrain timber blocks so as to interconnect said timber frame members and said endgrain timber blocks to one another.

5. A prop headboard according to claim 4 wherein an operative underside of said frame is formed with a central recess of circular shape adapted to receive an upper end of an elongate prop, said recess being formed at least partially in said endgrain timber blocks.

6. A prop system according to claim 1 wherein said bag-retaining flaps are folded over the grout bag in overlapping relationship.

7. A prop system according to claim 1 wherein said fabric flaps have a width that is approximately equal to the width of said bag-supporting planar surface.

8. A prop system, comprising: an elongate prop extending upright from the footwall towards the hanging wall in a mine working, a prop headboard mountable transversely on top of the elongate prop and an inflatable grout bag which can be supported on the prop headboard and inflated with settable grout so as to expand into contact with the hanging wall and thereby place the elongate prop under a compressive preload force, wherein the headboard comprises:

a plurality of timber members connected to one another to form a frame which is mountable on the elongate prop, said frame including a first series of parallel, interconnected elongate timber frame members and a second series of parallel, elongate timber deck members which are connected to, and extend transversely over, said timber frame members and which, in combination with one another, present a generally planar support surface for the grout bag; and a length of flexible fabric material which is anchored between said timber frame members and said timber deck members and which extends beyond said frame to form a pair of flexible bag-retaining flaps at opposite ends of the frame, said flaps being foldable in opposite directions over the inflatable grout bag, thereby to centralize the grout bag on said planar surface and to restrain it against lateral movement relative to the frame when the grout bag is inflated.

9. A prop system according to claim 8 wherein the fabric material comprises woven polypropylene.

10. A prop system according to claim 9 and comprising a tying means attached to and extending from said bag-retaining flaps.

11. A prop system according to claim 8 comprising endgrain timber blocks which are located between the timber frame members and which space said timber frame members apart from one another, and further comprising wires which extend through said timber frame members and said endgrain timber blocks so as to interconnect said timber frame members and endgrain timber blocks to one another.

12. A prop system according to claim 11 comprising a central recess of circular shape formed in said frame to receive an upper end of an elongate prop, the recess being formed at least partially in said endgrain timber blocks.

13. A prop system according to claim 11 wherein said fabric flaps have a width that is approximately equal to the width of said bag-supporting planar surface.

* * * * *